United States Patent [19]

Morin et al.

[11] 4,174,587

[45] Nov. 20, 1979

[54] AIR TURBINE OPERATED VEHICLE ACCELERATOR TOY

[75] Inventors: Marius J. Morin, Rancho Palos Verdes; Otto L. Gabler, Lawndale; Eugene J. Kilroy, Palos Verdes Estates, all of Calif.

[73] Assignee: Mattel, Inc., Hawthorne, Calif.

[21] Appl. No.: 832,418

[22] Filed: Sep. 12, 1977

[51] Int. Cl.[2] ..... A63H 29/16

[52] U.S. Cl. ..... 46/1 K; 46/44; 46/175 R; 273/86 D

[58] Field of Search ..... 46/1 K, 44, 202, 175; 273/86 H, 86 D

[56] References Cited

U.S. PATENT DOCUMENTS

| | | | |
|---|---|---|---|
| 1,258,471 | 3/1918 | Schlaepfer et al. | 417/511 |
| 1,402,222 | 1/1922 | Evans | 417/511 |
| 2,604,055 | 7/1952 | Snowden | 101/73 |
| 2,913,293 | 11/1959 | Dibley et al. | 309/23 |
| 3,315,966 | 4/1967 | Allen | 46/44 |
| 3,367,658 | 2/1968 | Bayha | 273/86 |
| 3,469,340 | 9/1969 | Breneman et al. | 46/44 |
| 3,590,524 | 7/1971 | Beny et al. | 46/202 X |
| 3,599,365 | 8/1971 | Carver et al. | 46/202 |
| 3,641,704 | 2/1972 | Sims et al. | 46/202 X |
| 3,697,071 | 10/1972 | Anderson | 273/86 D |
| 3,789,540 | 2/1974 | Convertine et al. | 46/202 X |

FOREIGN PATENT DOCUMENTS

| | | | |
|---|---|---|---|
| 1030238 | 3/1953 | France | 273/86 D |

*Primary Examiner*—F. Barry Shay

*Attorney, Agent, or Firm*—John G. Mesaros; Max E. Shirk; Ronald M. Goldman

[57] ABSTRACT

A toy for accelerating unpowered toy vehicles along a roadway, the accelerator having a base with a roadway portion formed therein, the base having opposing elongate slots on either side of the roadway portion with vehicle engaging rollers rotatably mounted within the base and extending through the slots for engaging the vehicles sides. An air pump is provided, depression of which operates turbine means coupled to drive the rollers in opposite directions.

8 Claims, 6 Drawing Figures

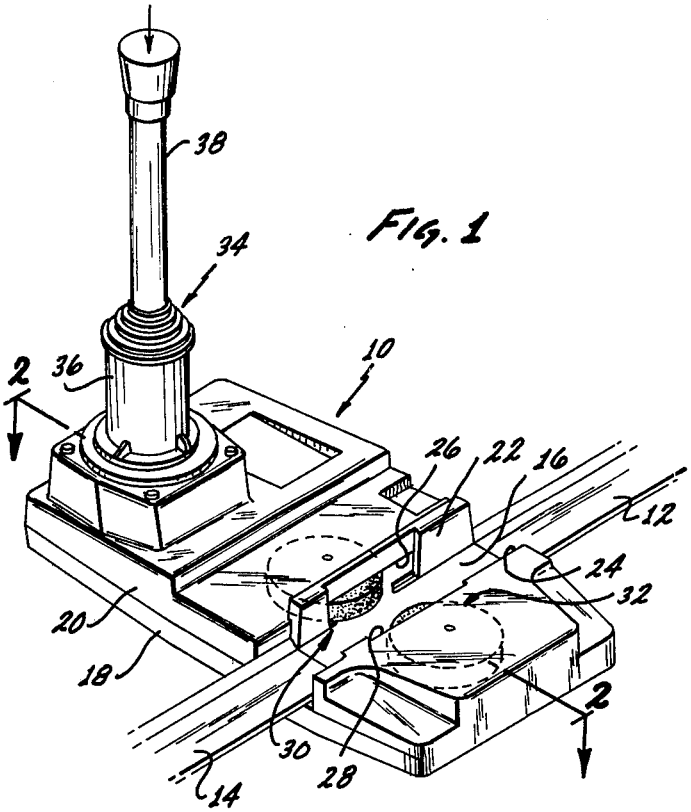
FIG. 1
FIG. 5
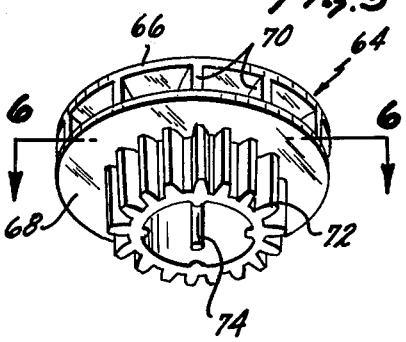
FIG. 6
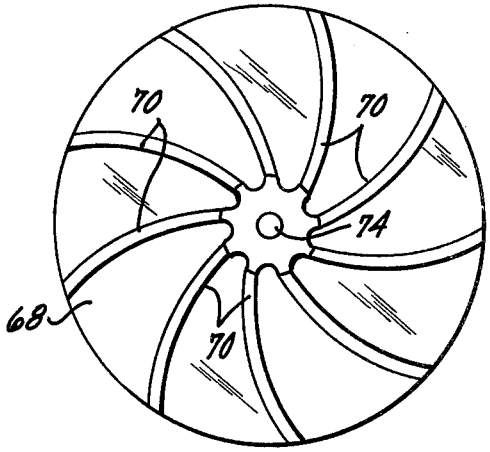

AIR TURBINE OPERATED VEHICLE ACCELERATOR TOY

BACKGROUND OF THE INVENTION

The background of the invention will be discussed in two parts:

1. Field of the Invention

This invention relates to toys and more particularly to a toy for accelerating unpowered toy vehicles along a roadway.

2. Description of the Prior Art

Toy vehicles such as miniature cars are well known in the art, such vehicles commonly employing accessories such as track sections to provide a roadway. Such track sections are usually flexible and often times have clamp means for clamping one end of the roadway to an elevated structure for permitting the toy vehicles to operate under the force of gravity. More elaborate arrangements include banked curved sections which enable the track sections to be joined to form a closed loop. In such a closed loop arrangement, a toy vehicle accelerator is generally employed such as that shown and described in U.S. Pat. No. 3,590,524 issued July 6, 1971 and assigned to the assignee of the instant invention. In the accelerator of that patent, a housing is provided with a portion of the roadway formed therein with counter-rotating rollers on opposite sides of the roadway portion for engaging the sides of the vehicle to provide the acceleration power. The rollers are motor-operated at a generally constant speed by an electrically powered motor.

Another toy vehicle propulsion unit is shown and described in U.S. Pat. No. 3,599,365, the unit being spring-operated and actuated by a trigger contacted by the vehicle to release the spring actuated arm which engages the rear of the vehicle to propel it forward.

Propulsion systems for toy vehicles utilizing air are shown and described in U.S. Pat. Nos. 3,469,340; 3,697,071; and 3,789,540. In the first two mentioned patents, the systems employ conduits through which the vehicles travel under force of the air while in the last mentioned patent, the compressed air is utilized to activate an air-operated motor within the vehicle itself. In this case, the coupling means for transferring air to the vehicle must be movable to a position out of engagement with the vehicle.

It is an object of this invention to provide a new and improved toy vehicle accelerator.

It is another object of this invention to provide a new and improved toy vehicle accelerator for unpowered toy vehicles.

It is a further object of this invention to provide a toy vehicle accelerator having vehicle engaging rollers operable through a wide range of speeds by an air pump.

SUMMARY OF THE INVENTION

The foregoing and other objects of the invention are accomplished by providing a toy for accelerating unpowered toy vehicles along a roadway, the accelerator including a housing or base having a portion of the roadway thereon with elongate slots in the opposing sidewalls adjacent the roadway portion. Vehicle engaging rollers extend partially through the slots and are simultaneously rotatable in opposite directions to engage the vehicle sides for accelerating the vehicles. The rollers are gear coupled to a turbine operable through a range of speeds by an air pump. The turbine housing is provided with sound emitting means in proximity to the outlet end of the conduit interconnecting the air pump and the turbine housing.

Other objects, features and advantages of the invention will become apparent from a reading of the specification when taken in conjunction with the drawings in which like reference numerals refer to like elements in the several views.

BRIEF DESCRIPTION OF THE DRAWINGS

FIG. 1 is a perspective view of the toy vehicle accelerator according to the invention;

FIG. 5 is a perspective view of the turbine; and

FIG. 6 is a cross-sectional view of the turbine of FIG. 5 taken along line 6—6 thereof.

DESCRIPTION OF THE PREFERRED EMBODIMENT

Figure 2:
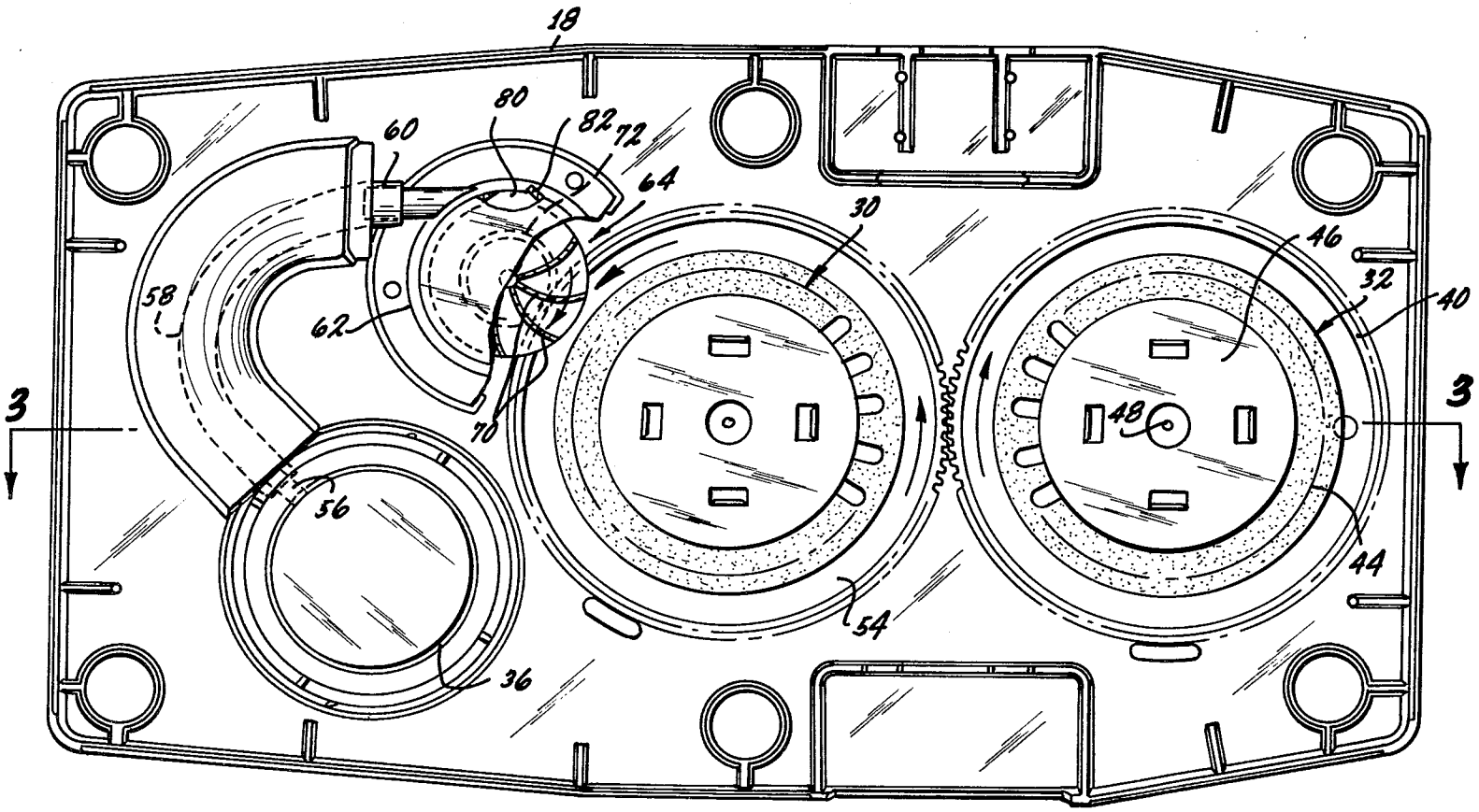
FIG. 2 is a plan view, partially in cross section, showing the bottom half of the housing of the accelerator of FIG. 1 as viewed generally along line 2—2 thereof.

Referring now to the drawings and particularly to FIG. 1, there is shown a toy vehicle accelerator generally designated 10 coupled to first and second vehicle track sections 12 and 14 on either end of a roadway portion 16. The accelerator 10 has a base portion or housing which includes a lower housing portion 18 and an upper housing portion 20, each of which is a generally shell-like construction matingly assembled to form a hollow interior for receiving components therein. The roadway portion 16 is formed integrally within the base or housing wherein the upper housing portion 20 is suitably configured with opposing sidewalls 22 and 24 on either side of the roadway portion 16. Sidewalls 22 and 24 have elongate slotted openings 26 and 28 formed therein with vehicle engaging roller members 30 and 32, respectively, extending through the slots 26 and 28 for engaging the sides of a toy vehicle traversing the roadway portion 16. The rollers 30 and 32 are mounted for rotation about parallel vertical axes, and as will be hereinafter discussed are coupled by means of gearing for rotation in opposite directions to provide equal forces to opposite sides of the vehicle so-engaged.

The rollers 30 and 32 are propelled by means of an air pump generally designated 34 which has a barrel portion 36 suitably coupled to the upper housing portion 20 and a handle assembly 38 operable downwardly as indicated by the arrow within barrel 36 to provide the air for the unit.

Figure 3:
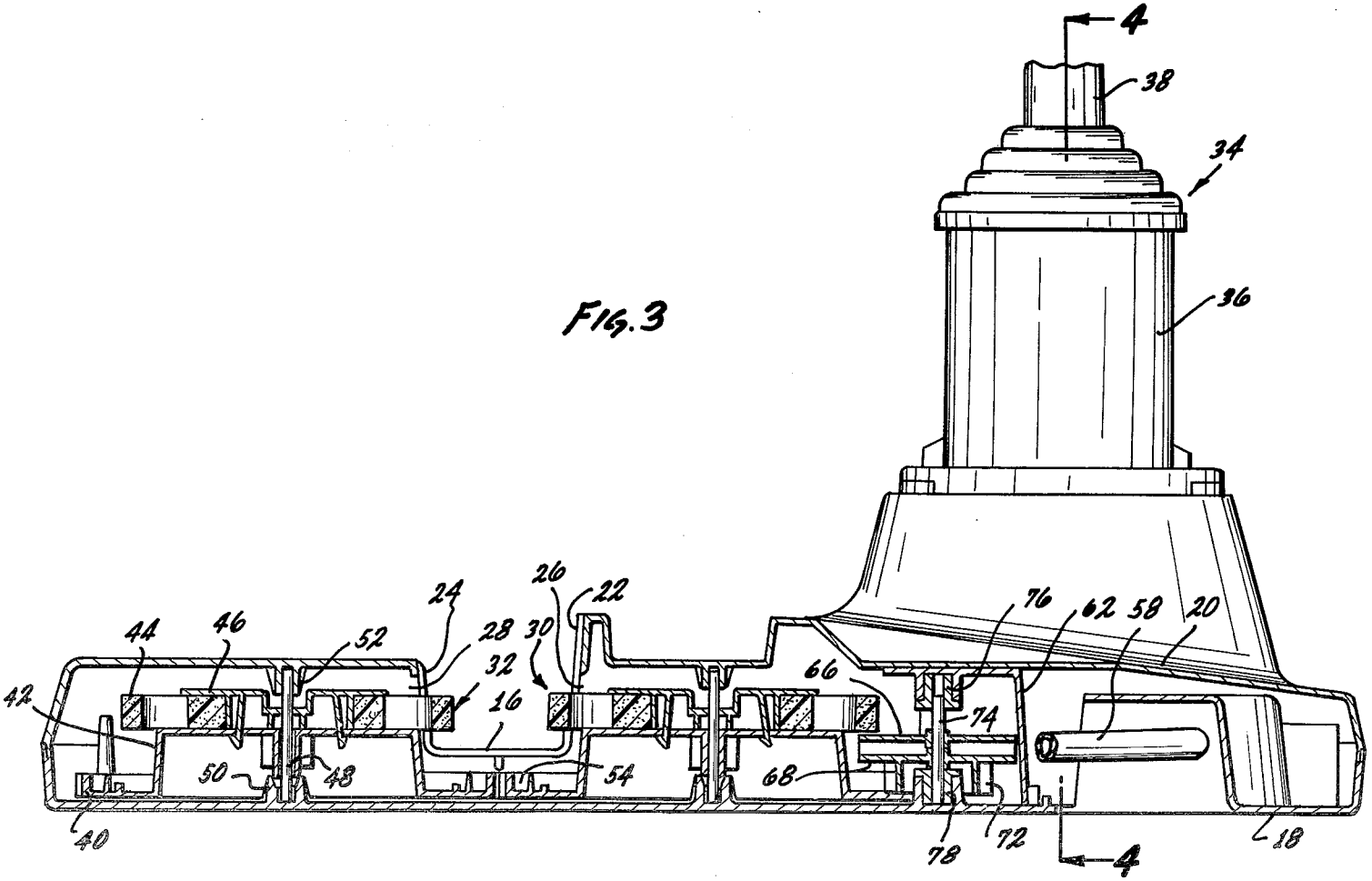
FIG. 3 is a cross-sectional view of the assembled accelerator of FIG. 1 taken generally along line 3—3 of FIG. 2.
Figure 4:
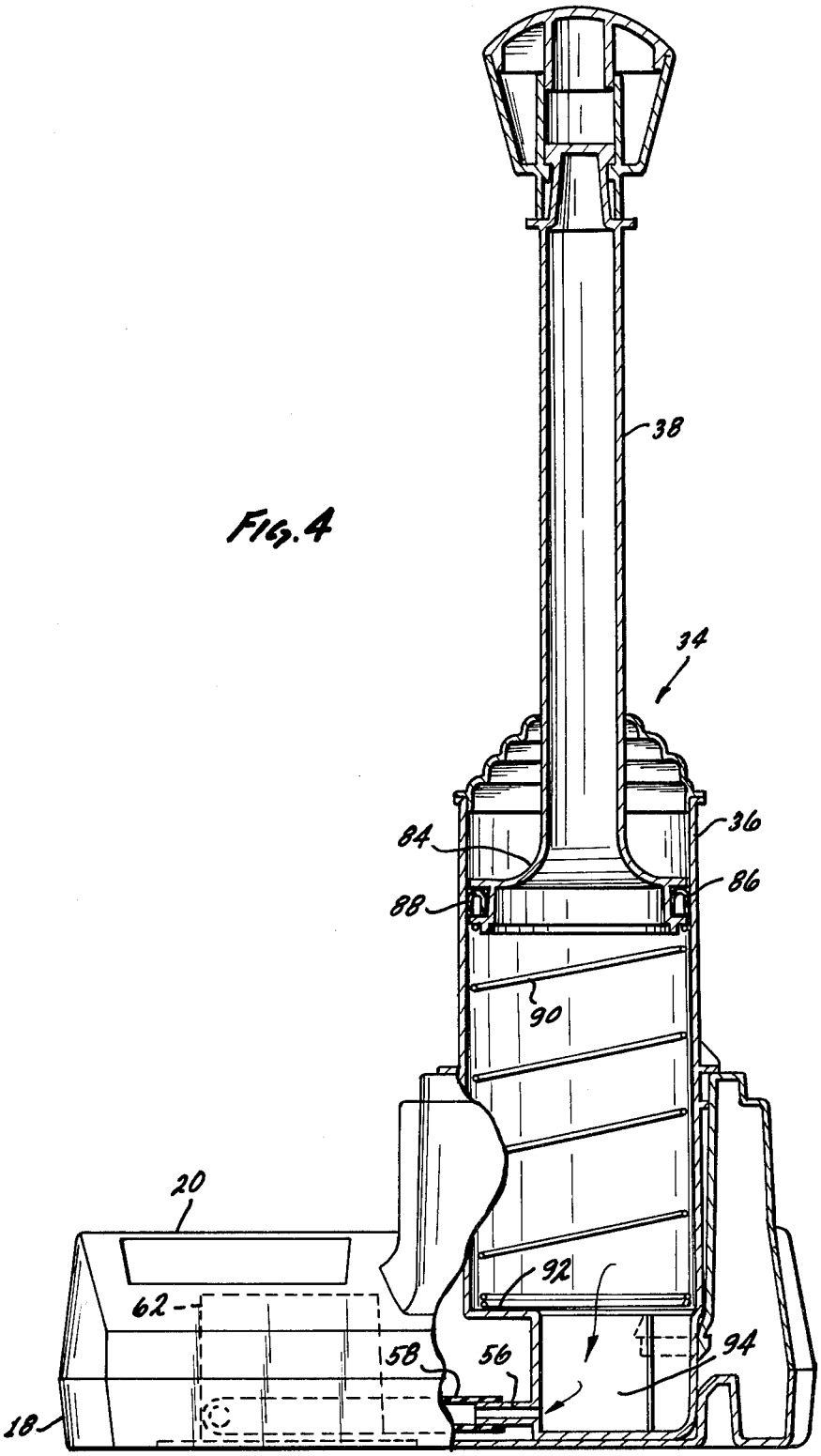
FIG. 4 is a cross-sectional view taken generally along line 4—4 of FIG. 3.

As shown in FIGS. 2–4, the vehicle engaging rollers 30 and 32 are identical and the details pertaining to only one need be discussed. The roller 32 has a main large diameter gear member 40 which is configured with a hollow upwardly extending circular portion 42 which has resting thereon a foam rubber wheel member 44 which is coupled to the circular portion 42 by means of a hub member 46. A suitable axle 48 extends through the assemblage and is rotatably coupled within the housing by means of bearing bosses 50 and 52 formed integrally within the lower housing portion 18 and upper housing portion 20, respectively. Similarly the assemblage of roller 30 has a main gear member 54 which has the gear teeth thereof in meshing engagement with the gear teeth of main gear member 40 of roller 32 resulting in simultaneous rotation in the direction of the arrows indicated in FIG. 2, that is, with roller member 30 rotating counterclockwise and roller member 32 rotating clockwise simultaneously at the same speed.

As best illustrated in FIGS. 2 and 3, the barrel 36 of the air pump 34 is provided at its lower end with a nipple outlet 56 to which is coupled a flexible plastic conduit 58, the other end of which is coupled to an inlet nipple 60 of an air turbine housing 62 which has rotatably mounted therein a turbine member generally designated 64. The housing 62 is arcuately configured and of a generally inverted truncated cup-shaped configuration with the air inlet nipple 60 thereof being generally tangential to the periphery of housing 62 for directing air passing through conduit 58 to one end of the turbine member 64.

As best illustrated in FIGS. 5 and 6, the turbine member 64 has upper and lower disc members 66 and 68 in spaced parallel relation with a plurality of radially extending arcuate vanes 70 forming a web between the disc members 66 and 68. Extending downwardly from the underside of turbine member 64 is an integral pinion member 72 with an axle 74 (see also FIG. 3) being inserted through the turbine member 64 for rotatable mounting within bearing bosses 76 and 78 within turbine housing 62 for rotation of the turbine member 64 on a vertical axis. The positioning of axle 74 is such that the pinion gear member 72 is in meshing engagement with the main gear member 54 of roller member 30 to thereby provide an air-operated motor for propelling the rollers 30 and 32. As shown in FIG. 4, the air inlet nipple 60 is in alignment with the plane between the discs 66 and 68 to thereby direct the flow of air from the barrel 36 of the air pump 34 into contact with the vanes 70 to provide the direction of rotation indicated by the arrow on the turbine member 64 as shown in FIG. 2. Also, as shown in FIG. 2, in proximity to the air inlet nipple 60 formed within housing 62 there is located an aperture 80 through which air passing from inlet nipple 60 is deflected over a sharp edge 82 to provide a whistle-like sound.

Referring now to FIG. 4, the handle 38 of air pump 34 terminates in enlarged circular portion 84 having a peripheral recess 86 for captively receiving therein a gasket member 88 in close sliding engagement with the interior of barrel 36. A coil spring 90 is positioned within barrel 36 to urge handle 38 upwardly, the spring 90 resting at its lower end on a shoulder 92 formed on the interior of barrel member 36. Beneath shoulder 92, there is an air outlet chamber 94 in fluid communication with the air outlet nipple 56 to pass air through conduit 58 to the turbine member 64.

In operation, the handle 38 of the air pump 34 can be repeatedly depressed downwardly while returning to its normal position under force of coil spring 90. In operation, this air is directed through conduit 58 through inlet nipple 60 of turbine housing 62 into moving contact with the vanes 70 of turbine member 64 which are arcuately configured to provide a trough which is intercepted by the air from air pump 34. This movement of air through inlet nipple 60, in addition to causing turbine 64 to rotate clockwise as viewed in FIG. 2 also passes through the aperture 80 into contact with the whistle edge 82 to emit an audible sound. As turbine 64 rotates clockwise, roller 30 rotates counterclockwise while roller 32 rotates clockwise. The speed of depression of the handle 38 of air pump 34 as well as the repetitive frequency of depression controls the volume of air flowing to the turbine member 64 to thereby provide a variable rate air powered accelerator for unpowered toy vehicles traversing the roadway portion 16 of the accelerator 10. Because of the variable acceleration rate, the amusement value is greatly enhanced in a simulated racing situation wherein two tracks side by side are utilized by two participants to engage in a racing situation. Furthermore, because of the vertical alignment of the air pump 34 operating against the surface, such as a table or a floor, on which the accelerator 10 is situated, a child of tender years can operate the toy vehicle accelerator since only a downward depression is required with a self-return action created by the coil spring 90. With mechanically actuated accelerators which require a cocking action against the force of a spring, children of tender years have difficulty due to the lack of strength. In electrical motor operated accelerators, the speed is determined by the motor and by the condition of the battery used to operate the motor.

Accordingly, with a variable speed air pump operated accelerator, the use of the device by children of tender years is possible while older children can find additional amusement value due to the additional skill required in a variable speed accelerator. While there has been shown and described a preferred embodiment, it it to be understood that various other adaptations and modifications may be made within the spirit and scope of the invention.

What is claimed is:

1. A toy for accelerating unpowered toy vehicles along a roadway comprising:
   - a housing having a roadway portion thereon;
   - a pair of vehicle engaging rollers rotatably mounted opposite each other on opposite sides of said roadway portion;
   - an air pump coupled to said housing;
   - turbine means rotatably mounted within said housing, said turbine means including a turbine housing and a turbine, said turbine housing including air inlet means for directing air into said turbine, said turbine housing having means for providing an audible sound as the toy is operated, said sound providing means including an aperture in said turbine housing adjacent said air inlet means whereby air passing through said inlet means is deflected over an edge of said aperture to cause said sound;
   - means coupling said turbine to said rollers for rotation of said rollers in opposite directions in response to rotation of said turbine; and
   - conduit means coupled to said air pump for directing air from said pump into said turbine means to rotate said turbine whereby to accelerate vehicles in said roadway portion in a predetermined direction.

2. The combination according to claim 1 wherein said turbine is mounted for rotation about an axis perpendicular to the plane of said roadway portion and said rollers are mounted for rotation about axes parallel to the axis of rotation of said turbine.

3. The combination according to claim 2 wherein each of said rollers includes a main gear member with each of said main gear members in meshing engagement with each other.

4. The combination according to claim 3 wherein said turbine includes a pinion gear coupled in meshing engagement with one of said main gear members.

5. The combination according to claim 4 wherein said housing has opposing sidewalls adjacent said roadway portion and said sidewalls have elongate slots therein with a portion of said rollers extending therethrough for engaging a vehicle in said roadway portion.

6. The combination according to claim 7 wherein said turbine includes first and second circular disc members in spaced parallel relation with radially extending arcuately configured vanes therebetween.

7. The combination according to claim 6 wherein said air inlet means is in spaced proximate relation to the periphery of the vanes of said turbine.

8. The combination of claim 7 wherein said air pump includes a spring-biased handle assembly.

* * * * *